United States Patent [19]

Carney et al.

[11] Patent Number: 4,721,587

[45] Date of Patent: Jan. 26, 1988

[54] PROCESS OF MAKING HEAT-STRENGTHENED YARN

[75] Inventors: Thomas E. Carney, Wilmington; Abraham Matthews, Newark, both of Del.

[73] Assignee: E. I. Du Pont de Nemours and Company, Wilmington, Del.

[21] Appl. No.: 743,902

[22] Filed: Jun. 12, 1985

[51] Int. Cl.[4] ..... D01D 10/02

[52] U.S. Cl. ..... 264/130; 264/345; 264/234; 264/85; 264/131; 427/397.7

[58] Field of Search ..... 264/345, 131, 210.3, 264/234, 130, 85; 427/171, 174, 176, 397.7

[56] References Cited

U.S. PATENT DOCUMENTS

| | | | |
|---|---|---|---|
| 2,782,090 | 2/1957 | Robbart | 427/176 |
| 3,140,957 | 7/1964 | Tanabe et al. | 264/210.3 |
| 3,540,203 | 11/1970 | Thoresen et al. | 264/131 |
| 3,975,482 | 8/1976 | Rulison | 427/174 |
| 4,083,829 | 4/1978 | Calundann et al. | 528/193 |
| 4,118,372 | 10/1978 | Schaefgen | 528/190 |
| 4,153,779 | 5/1979 | Jackson, Jr. et al. | 528/190 |
| 4,183,895 | 1/1980 | Luise | 528/191 |
| 4,424,184 | 1/1984 | Eskridge et al. | 264/346 |
| 4,525,384 | 6/1985 | Aoki et al. | 264/131 |

FOREIGN PATENT DOCUMENTS

| | | | |
|---|---|---|---|
| 0121132 | 10/1984 | European Pat. Off. . | |
| 1469241 | 1/1969 | Fed. Rep. of Germany . | |
| 54-27034 | 9/1979 | Japan | 427/174 |

*Primary Examiner*—Jan H. Silbaugh
*Assistant Examiner*—Hubert C. Lorin

[57] ABSTRACT

Application of hydrophobic silica to an anisotropic-melt forming polyester yarn reduces interfilament and intrafilament fusion during heat-strengthening. Improvements in adhesion of yarn to certain matrices are noted.

4 Claims, No Drawings

PROCESS OF MAKING HEAT-STRENGTHENED YARN

BACKGROUND OF THE INVENTION

The strengthening of yarn spun from anisotropic-melt forming polyesters is taught in Luise U.S. Pat. No. 4,183,895. The Patenteeacknowledges that heat treatment may cause fusion between the filaments which can make it impractical to rewind the yarn. It is suggested in said patent that useful results have been obtained if the filaments are precoated with a thin layer of an inert substance, for example, talc, graphite or alumina. Further improvements are, however, desired to prevent sticking of filaments to each other during heat treatment. The use of anisotropic-melt polyester fiber has been suggested for composite reinforcement. The need to promote the adhesion of such fiber to matrices in composites has also been recognized. This invention provides improvements in these areas.

SUMMARY OF THE INVENTION

The present invention provides a process for heat strengthening a yarn spun from an anisotropic-melt forming polyester without substantial interfilament or intrafilament fusion. The yarn is coated with a dispersion of hydrophobic silica having an average primary particle size below about 50 nanometers in a liquid carrier and heated in a substantially inert atmosphere below the filament melting point for a time sufficient to increase yarn tenacity. The precursor and end-product yarn as well as certain resin matrix composites reinforced with such yarns are also part of the invention.

DETAILED DESCRIPTION OF THE INVENTION

A class of wholly aromatic polyesters that form optically anisotropic melts from which oriented filaments can be melt spun is described in Schaefgen U.S. Pat. No. 4,118,372. Other anisotropic-melt forming polyesters are disclosed in U.S. Pat. Nos. 4,083,829; 4,153,779 and in many other patents and applications. The as-spun oriented fibers from such polyesters are strengthened by heating while essentially free from tension and in an essentially inert atmosphere. The conditions of heat treatment are fully described in U.S. Pat. No. 4,183,895.

In accordance with this invention as-spun anisotropic-melt forming polyester filament yarn is first coated with a hydrophobic silica having an average primary particle size below about 50 nanometers (nm). The term primary refers to the non-agglomerated particle. The filament yarn may be a multifilament yarn or a heavy denier monofilament yarn.

The hydrophobic silicas used in the examples below are fumed silicas referred to as Aerosil®R-972 or R-976 produced by Degussa Corporation. They are identified and described in Degussa trade literature of 6/26/84. Aerosil®R-972, for example, is produced by treating a standard Aerosil type 130 which has 3–4 hydroxyl groups per square nanometer and a surface area of about 130 $m^2/gm$ with dimethyl dichlorosilane at above 500° C. in a continuous process. It is believed that other hydrophobic silicas should also be useful. Some are described in the aforementioned Degussa publication. Other particulate materials disclosed in the prior art are distinguishable from the hydrophobic silica employed herein. Thus, graphite is not as effective in preventing interfilament adhesion and presents housekeeping problems due to flaking of the graphite off the filaments. Further, neither graphite nor hydrophilic silica provides the high adhesion levels of the fiber to epoxy matrix materials as does hydrophobic silica. Hydrophilic silica also tends to agglomerate, making it less effective in preventing filament sticking. One disadvantage of alumina is the fact that it is abrasive and can present wear problems on rolls. Thus, the hydrophobic silica presents many advantages over products heretofore suggested in the art.

The hydrophobic silica is preferably applied from a dispersion in an organic liquid carrier although any compatible liquid carrier may be used. The preferred liquid carrier is a polar fluid preferably one having a high density. Chlorinated hydrocarbons, such as perchloroethylene are useful. Methylene chloride and methanol mixtures have also been used with good results. The particular carrier employed is not believed to be critical. The dispersion is applied to uniformly deposit at least about 2 $\mu g$ and up to 100 $\mu g$ of hydrophobic silica per square centimeter of filament surface area. Greater amounts may be used but no advantage is expected in the use of such larger amounts.

After the yarn is coated, it is subjected to a heat treatment to strengthen the yarn. This treatment is described in the aforementioned U.S. Pat. No. 4,183,895. If desired, an accelerator can be used as described in U.S. Pat. No. 4,424,184. The yarn is heated, preferably without tension, at a temperature in excess of 250° C. but below the filament melt temperature, preferably in an inert atmosphere and for a time sufficient to increase tenacity, preferably by at least 50%, over the as-spun yarn. In the course of this process, the hydrophobic silica particles are firmly attached to the filament surface and remain substantially uniformly distributed along the surface. Interfilament and intrafilament fusion appears to be substantially avoided. Thus, in the case of the heavy denier monofilament yarn, fusion between contacting segments of the filament will be reduced during the heat treatment while in the case of multifilament yarn fusion is avoided between adjacent filaments and contacting yarn segments.

Yarns produced in accordance with this invention are useful in epoxy resin matrix composites as reinforcement. In such applications they have been shown to exhibit improved adhesion. The reinforcement is ordinarily employed in proportions between 5 and 70 volume percent based on fiber reinforced matrix composite. Improved adhesion to rubber is found where the yarns are given an epoxy subcoat.

Test Procedures

Tensile properties for multifilament yarns were measured with a recording stress-strain analyzer at 21° C. and 65% relative humidity using 3 turns-per-inch twist and a gauge length of 5 in (12.7 cm). Results are reported as T/E/M, where T is break tenacity in grams per denier, E is elongation-at-break expressed as the percentage by which the initial length increased, and M is the initial tensile modulus in grams per denier (gpd). Average tensile properties for at least three specimens are reported.

When considering the examples that follow, it should be understood that the results reported are believed to be representative and may not constitute all of the runs performed.

EXAMPLE 1

A coating dispersion is prepared from 10 gm of fumed, hydrophobic silica (Aerosil ®R-972 from Dugussa with a 16 nanometer average primary particle size) and 600 gm of perchloroethylene by stirring until a homogeneous, white, colloidal dispersion is obtained. Several meters of an 870-denier, anisotropic-melt polyester yarn (ca. 8.7 dpf) prepared in accordance with the general techniques of U.S. Pat. No. 4,183,895 from a polymer of the following composition—chlorohydroquinone (40 mole %), 4,4'-dihydroxydiphenyl (10 mole %), terephthalic acid (40 mole %) and isophthalic acid (10 mol %)—are immersed in the dispersion for several minutes. The coated yarn sample was gently removed from the dispersion and placed on Fiberfrax ® (a batted ceramic insulation of the Carborundum Company) in a perforated metal basket. A control yarn without coating from the same source was placed in a similar basket. The yarn samples were then heat strengthened in an oven purged with nitrogen following a programmed, 16 hr., heating cycle with a maximum temperature of about 306° C. In the cycle the oven is purged with nitrogen at room temperature (RT), for about ½ hr, and then the temperature is gradually elevated from RT to 200° C. in 2 hr, 200° C. to 306° C. in 7.3 hr, held at 306° C. for 7.5 hr, and then cooled to RT. After heat treatment, the control yarn was fused while individual filaments could be easily separated from the fumed-silica-coated yarn. The silica particles appear to be strongly adhered to the fiber surface. About 50 μg per $cm^2$ of yarn is determined to be present. Observations in a scanning electron microscope showed a uniform distribution of silica particles on the fiber surface.

EXAMPLE 2

A 60 denier, 10-filament yarn spun from polymer of the same composition as Example 1 was immersed in a hydrophobic silica dispersion as in Example 1 and then removed. Samples of this coated yarn and an uncoated control yarn from the same source were heat strengthened in 3.0-meter tube oven as described in Example 5 of U.S. Pat. No. 4,424,184. The sample yarns were placed on a continuous, glass-fiber belt and moved through the oven with about a 45 minute residence time. The oven was continuously purged with nitrogen flowing at about 0.3 SCF/min. A typical temperature profile, determined by use of thermocouples spaced about 30 cm apart starting 30 cm within the oven from the entrance, was 178°, 240°, 270°, 284°, 294°, 300°, 299°, 302° and 295° C. The uncoated yarn was fused while the coated yarn was not. (T/E/M of the fused yarn was 4.7 gpd/1.5%/282 gpd and the T/E/M of the coated yarn was 8.2 gpd/1.9%/473 gpd.)

EXAMPLE 3

A 60 denier, 10-filament yarn spun from polymer of the same composition as Example 1 was treated with a 1% aqueous KI solution (containing 0.1% Triton ®X-100 as surfactant) to accelerate heat-strengthening. A sample of the yarn was coated as in Example 1. Another sample was left uncoated. Both were heat strengthened following the procedure of Example 2. The uncoated yarn was fused while the coated yarn was not. (T/E/M of the fused yarn was 21.4 gpd/3.3%/527 gpd and the T/E/M of the coated yarn was 18.7 gpd/3.0%/531 gpd).

EXAMPLE 4

This example demonstrates the improvement in cord-to-rubber adhesion achieved with yarn of the invention as compared with similar yarn coated with graphite prior to heat treatment.

Hydrophobic silica was applied to 1500 denier, 400-filament, as-spun yarn from the same polyester composition as in Example 1 from a 2% Aerosil ®R-972 dispersion in methanol/methylene chloride (75/25) at such a rate that 1.2% silica was deposited based on dry-yarn weight. The liquid medium was evaporated and the yarn piddled into a perforated metal basket. Similarly, graphite was applied to 1500 denier, 400-filament, as-spun yarn from a 12% Microfyne flake graphite (Joseph Dixon Crucible Co.) dispersion in methanol/methylene chloride (75/25). The yarns were heat strengthened in an oven purged with nitrogen using a 16 hr. programmed heating cycle with a maximum temperature of about 306° C. as in Example 1. They were backwound with the application of a lubricating finish and twisted to 1500/1/2, 6.5 TM (twist multiplier) cords.

A commercial, single-end, cord-treating unit (Litzler Co.) was used to apply and cure an epoxy subcoat and resorcinol formaldehyde latex (RFL) topcoat to the cords. The epoxy subcoat was cured at 450° F./60 sec/7 lb tension; the RFL topcoat was cured at 475° F./90 sec/3.5 lb tension.

A 120° C., 2-ply, strap-adhesion test (ASTM D-2630-71) was used to evaluate the cord-to-rubber adhesion. The results below show that the silica coating improves both the peel strength and the appearance rating.

| Item | Coating | Peel Strength (lb/in) | Appearance Rating* |
|---|---|---|---|
| A | Silica | 51 | 4.5 |
| B | Graphite | 38 | 1.9 |

*5 = all rubber tear, no cord visible, to 1 = no rubber on cords.

EXAMPLE 5

This example demonstrates the improvement in cord-to-rubber adhesion achieved with yarn of the invention as compared with similar yarn coated with hydrophilic silica (Aerosil ®200).

In separate runs, hydrophobic silica Item A and hydrophilic silica Item B were applied to yarns as in Example 4 and the yarns were similarly treated and incorporated into a rubber matrix and then tested (ASTM D-2630-71). The results were as follows:

| Item | Coating | Peel Strength (lb/in) | Appearance Rating* |
|---|---|---|---|
| A | Hydrophobic Silica | 40 | 4.3 |
| B | Hydrophilic Silica | 36 | 2.3 |

*As in Example 4.

EXAMPLE 6

A 200 filament, approximately 760 denier yarn was prepared from an anisotropic melt polyester of the following composition—chlorohydroquinone (50 mole %), terephthalic acid (35 mole %) and 2,6-dicarboxynaphthalene (15 mole %). Samples of the yarn were coated with hydrophobic silica and then heat strengthened as in Example 4. The yarn was essentially free of fused filaments.

EXAMPLE 7

This example demonstrates the improvement in fiber-to-matrix adhesion achieved with yarn of the invention compared to similar yarn coated with graphite prior to heat treatment.

Hydrophobic silica and graphite were applied to 940 denier, 200-filament, as-spun yarn from dispersions in methanol/methylene chloride (75/25) as in Example 4. The yarns were heat strengthened in an oven purged with nitrogen using a 16 hr. programmed heating cycle with a maximum temperature of about 306° C. in Example 1.

Unidirectional composite bars were prepared for testing using these heat-strengthened coated yarns and an epoxy matrix following the procedures found in U.S. Pat. No. 4,418,164 for filament winding (except as otherwise indicated). The bars were wound using undried yarn and a mixture of 100 parts of diglycidyl ether of bisphenol-A (Epon 826 Shell), 25 parts of 1,4-butanediol diglycidyl ether (Araldite RD-2 Ciba-Geigy) and 30 parts aromatic diamine curing agent (Tonox, Uniroyal). They were cured for 1.5 hr. at 120° C. followed by 1 hr. at 175° C.

Short-beam-shear test (ASTM D-2344-76) with samples tested at a 4:1 span to depth ratio) results on these bars indicated a substantial improvement in adhesion between fiber and matrix for the hydrophobic silica-coated yarn compared to the graphite-coated yarn (6430 vs. 4500 psi, respectively).

EXAMPLE 8

Hydrophobic silica (Aerosil ®R-976 with a 7 nanometer average primary particle size) was applied from a 5% dispersion in methanol/methylene chloride (75/25) using a finish application roll to about a 400-denier monofilament yarn spun from a polymer with the composition of Example 1. The coated monofilament was wound on a six-inch diameter, perforated metal bobbin wrapped with Fiberfrax ®. The bobbin of monofilament yarn was heat strengthened in an oven purged with nitrogen using a 16-hr programmed heating cycle with a maximum temperature of about 306° C. similar to Example 1. The heat-treated monofilament yarn was not fused and could be easily backwound from the bobbin.

What is claimed is:

1. In a method for heat-strengthening a yarn spun from an anisotropic-melt forming polyester wherein a yarn comprising one or more filaments is subjected to a heat treatment in a substantially inert atmosphere at temperatures below the filament melting point for a time sufficient to increase the yarn tenacity, the improvement comprising coating the yarn before the heat treatment with a dispersion of hydrophobic silica having an average primary particle size less than about 50 nanometers in a liquid carrier whereby interfilament and intrafilament fusion is substantially eliminated.

2. The method of claim 1 wherein the liquid carrier is an organic liquid.

3. The method of claim 1 wherein the yarn is coated with at least about 2 $\mu$g of hydrophobic silica per square centimeter of filament surface area.

4. The method of claim 3 wherein the yarn is coated with between about 2 $\mu$g and 100 $\mu$g of hydrophobic silica per square centimeter of filament surface area.

* * * * *